United States Patent [19]

Puerner

[11] Patent Number: 4,971,571

[45] Date of Patent: Nov. 20, 1990

[54] SELF-LOCKING PIN FIELD CONNECTOR

[75] Inventor: Dean A. Puerner, Maricopa, Ariz.

[73] Assignee: AMP Incorporated, Harrisburg, Pa.

[21] Appl. No.: 494,053

[22] Filed: Mar. 15, 1990

[51] Int. Cl.[5] ..... H01R 4/50

[52] U.S. Cl. ..... 439/346; 439/372

[58] Field of Search ..... 439/346, 347, 372, 441, 439/571, 574, 575, 576

[56] References Cited

U.S. PATENT DOCUMENTS

| | | | |
|---|---|---|---|
| 2,744,968 | 5/1956 | Blackhall | 439/372 X |
| 3,705,376 | 12/1972 | Kinkaid et al. | 439/161 |
| 3,918,878 | 11/1975 | Lemke et al. | 439/70 |
| 3,942,285 | 2/1974 | Ouchi | 439/346 |
| 4,062,061 | 12/1977 | Doty et al. | 439/264 |
| 4,140,361 | 2/1979 | Sochor | 439/682 |
| 4,173,387 | 11/1979 | Zell | 439/557 |
| 4,178,051 | 12/1979 | Kocher et al. | 439/157 |
| 4,241,966 | 12/1980 | Gomez | 439/157 |
| 4,306,758 | 12/1981 | Johnson et al. | 439/372 X |
| 4,469,388 | 9/1984 | Narozny | 439/153 |
| 4,589,971 | 5/1986 | Szczesny | 439/395 |
| 4,597,618 | 7/1986 | Reimer | 439/374 |
| 4,627,674 | 12/1986 | Hamsher, Jr. et al. | 439/95 |
| 4,709,975 | 12/1987 | Williams, II | 439/372 X |
| 4,759,726 | 7/1988 | Naylor et al. | 439/441 |
| 4,761,141 | 8/1988 | Hawk et al. | 439/153 |

FOREIGN PATENT DOCUMENTS

| | | | |
|---|---|---|---|
| 0018552 | 11/1980 | European Pat. Off. | 439/347 |

*Primary Examiner*—Neil Abrams
*Assistant Examiner*—Khiem Nguyen
*Attorney, Agent, or Firm*—Anton P. Ness

[57] ABSTRACT

A connector has an integral locking system to be mountable to a pin field (20) without additional means by locking onto selected pins (92) at ends of rows of pins (26) to be electrically connected by the connector. To and along each side of a housing (16) are secured side members (54) movable vertically between actuated and unactuated positions defined by detents (72) in recesses (76A,76B). Lock plates (100) are held in pairs of opposed recesses (80,82) between each side member (54) and the opposed side face (56) of the housing in a horizontal orientation when unactuated, and include a pin-receiving aperture (106) aligned with a pin-receiving passageway (84) of the housing for receiving a pin (92) upon mounting. After mounting, actuation of the locking system occurs when each side member is forced toward the pin field and along the housing side rotating the outward end (104) of the lock plate downwardly and the inward end (102) upwardly, with the pin extending through the aperture defining the pivot. Each lock plate is held at an angle under tension by bearing surfaces (86,90) of the now-offset recesses so that the side edges (110) of the pin-receiving aperture of the lock plate bite into the sides of the pin (92) and firmly grip thereonto upon actuation. Deactuation is obtained by upward moving of the side members.

20 Claims, 8 Drawing Sheets

SELF-LOCKING PIN FIELD CONNECTOR

FIELD OF THE INVENTION

This relates to the field of electrical connectors and more particularly to electrical connectors mountable onto a pin field.

BACKGROUND OF THE INVENTION

Certain panels especially including printed circuit boards of large size include arrays of pins for electrical connection thereto for various purposes such as to transmit signals by individual contacts terminated onto individual electrical conductors or wires. Another purpose of the array is to allow selecting of certain ones after board manufacture for electrical connection, for customized programming. In such arrays a certain group thereof may be desired to be connected by a single connector containing respective contact means for the pins of the group, such as for transmission of electrical power to the board's circuits and components connected thereto.

While many examples of connectors are known for being electrically connected to pin arrays of finite size, the connectors require various means for being fastened to the board and usually include flange portions through apertures of which are inserted bolts which also require corresponding holes through the board, and usually also require access to the other side of the board for placement of a nut threaded onto the bolt shank. Certain connectors are also known again having flanges from which depend board lock means requiring at least apertures through the board to fasten themselves in. Other fastening methods include adhering or soldering of portions of the connector along its mating face, forming relatively permanent joints.

It is desired to provide a connector for a pin field of a panel or board which can be assuredly fastened to the pin field without additional hardware and without requiring tools.

It is also desired to provide such a connector for a pin field which does not require access to the opposite side of the panel or board for connector fastening.

It is further desired to provide a connector which can be assuredly fastened to a pin field without requiring mounting apertures through the panel or board.

It is yet further desired to provide a connector for a pin field which can be assuredly fastened thereto and easily removable therefrom when desired.

It is also additionally desired to provide a connector for a selected portion of a pin field which can be assured fastened thereto and easily removable therefrom without additional hardware or tools or require access to the opposite side of a panel or board.

SUMMARY OF THE INVENTION

The electrical connector of the present invention is an assembly of a body member, a rear cover member, a pair of side members and a pair of lock plates retained within the assembly, the assembly matable with a pin field and mountable thereonto by an integral locking system and not requiring mounting hardware The locking system of the present invention utilizes certain pins of the pin field to which it is mounted, and comprises at each side of the connector one of the side members latched onto a respective side face of the body member and adapted to be moved vertically therealong between an unactuated position and an actuated position defined by a detent and cooperating recesses therefor; each side member includes a lock plate recess opposed from a lock plate recess in the side face of the body member, and a lock plate is trapped therebetween with an inward end in the side face recess and an outward end in the side member recess. Each lock plate includes a pin-receiving aperture through which extends a pin of the pin array upon connector mounting to the array, to which the lock plate locks upon actuation of the respective side member. While the pins utilized for locking may be optionally used for electrical connection, they usually will be sacrificed and used strictly for connector mounting; the other pins are electrically engaged by corresponding receptacle contact means within the body member of the connector, which are terminated onto electrical conductor means extending from the rearward face or cable exit of the connector. The present connector for example is especially suitable for use with flat power cable wherein two cables are used for transmission of direct current, for power transmission to an array of power pin contacts on a printed circuit board.

In the locking system of the present invention, actuation of the locking system occurs when each of the pair of side members is forced toward the pin field and along the adjacent side face of the body member, which movement rotates the outward end of the lock plate downwardly and the inward end relatively upwardly, with the pin extending through the aperture defining the pivot. With the pin held within a closely dimensioned passageway of the body member, the lock plate is held at an angle under tension by bearing surfaces of the now-offset recesses so that the side edges of the pin-receiving aperture of the lock plate bite into the sides of the pin and firmly grip thereonto upon actuation. Upon deactuation by upward moving of the side members, the lock plates are rotated to a horizontal orientation releasing the respective pins and allowing removal of the connector from the pin field.

It is an objective of the present invention to provide a locking system for locking a device such as an electrical connector onto an array of pins without any other means.

It is a further objective to provide such a locking system to be easily actuated.

It is yet another objective to provide such a locking system to be easily deactuated and reactuated if desired.

It is still another objective to provide such a locking system to be compact and occupy little area beyond the area otherwise occupied by the device or connector.

It is also an objective of the present invention to provide a locking system which is adapted to be mountable onto a selected group of pins within a continuous pin field.

An embodiment of an electrical connector assembly including the locking system of the present invention will now be described with reference to the accompanying drawings.

DETAILED DESCRIPTION OF THE PREFERRED EMBODIMENT

Figure 1:
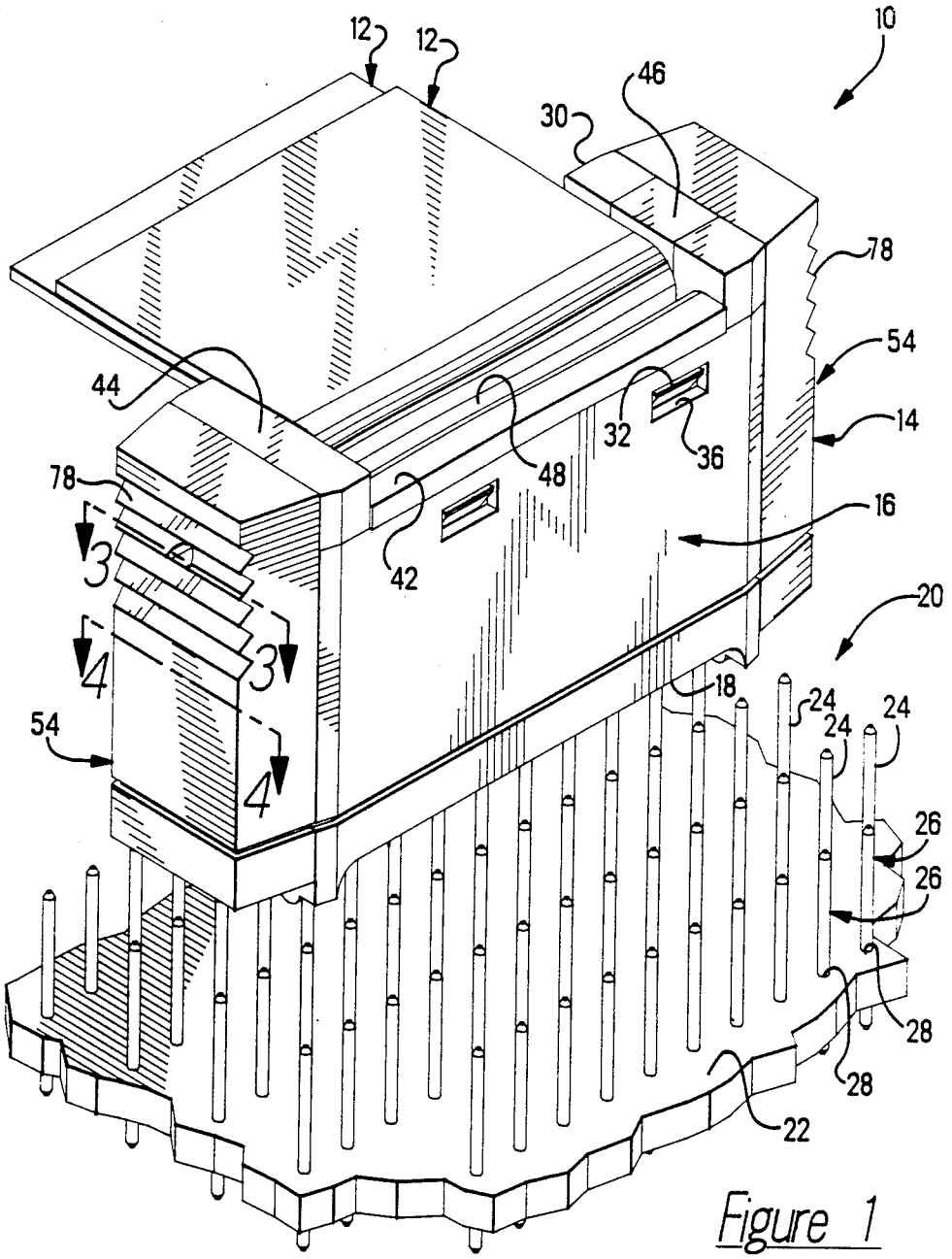
FIG. 1 is a perspective view of the assembled connector of the present invention about to be mated onto a pin array of a printed circuit board.

FIG. 1 shows the assembled connector assembly 10 in which terminated end portions of a pair of flat power cables 12 are contained in a housing assembly 14 including a housing body member 16 extending to a mating face 18. Connector assembly 10 is adapted to mate with a pin field 20 such as of a printed circuit board 22, for electrical connection of terminals on the ends of the cables 12 to pin contact sections 24 of an array of pin contacts 26 such as are mounted within respective through holes 28 of printed circuit board 22. Flat cables 12 enter connector assembly 10 through a cable exit at rear cover member 30 which serves to retain the terminated cable end sections within the housing assembly 14.

Figures 2, 5, 6:
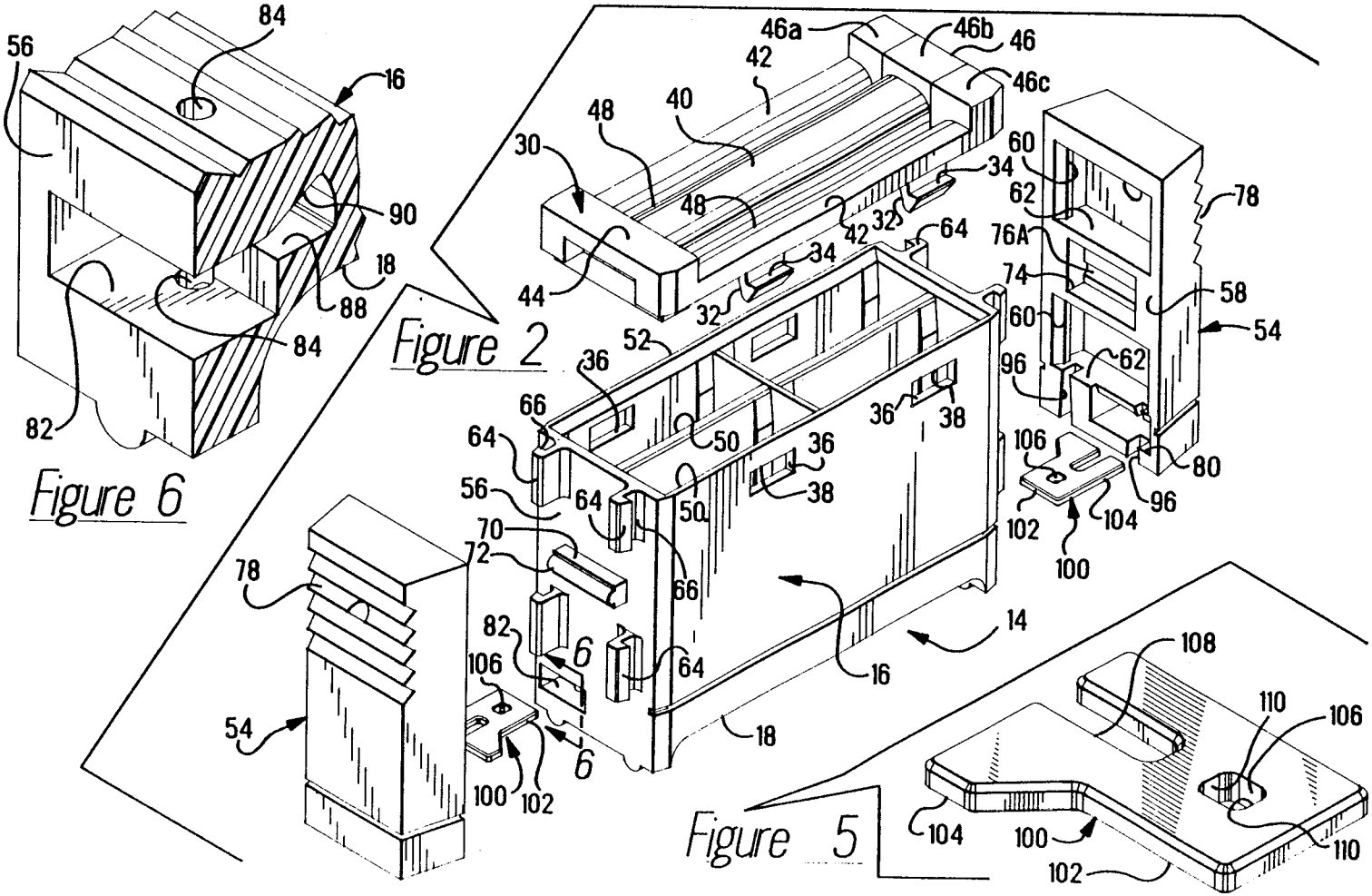
FIG. 2 is an exploded view of the housing assembly of the connector of FIG. 1.
FIG. 5 is an enlarged view of the lock plate of the present invention.
FIG. 6 is an enlarged part section view taken along lines 6—6 of FIG. 2 showing the profile of the plate-receiving recess of the housing body member.

In FIG. 2 can be seen the various parts of connector assembly 10. Rear cover member 30 is securable to body member 16 such as by pairs of latching projections 32 along both lateral sides thereof, defining latching surfaces 34 facing rearwardly to latch within corresponding latching recesses 36 along sides of body member 16 against forwardly facing latching ledges 38 when fully assembled. Rear cover member 30 may be molded of plastic in a single piece having an inner strut 40 and a pair of outer struts 42 extending laterally from a solid bight section 44 to free ends 46*a*,46*b*,46*c* together defining an opposed end 46; the inner strut 40 and each outer strut 42 define respective slots 48 therebetween through which extend respective ones of flat cables 12. Rear cover member 30 is adapted to be assembled over a pair of flat cables 12 after their terminated end sections have been inserted into terminal-receiving cavities 50 of body member 16, by struts 40,42,42 being separable at free ends 46*a*,46*b*,46*c* just far enough to receive the thicknesses of cables 12 therebetween from lateral edges thereof, after which strain relief member 30 is latched onto rearward end 52 of body member 16 with each flat cable 12 extending outwardly through a respective slot 48, as shown in FIG. 1. Upon latching to body member 16, free ends 46*a*,46*b*,46*c* are held firmly together, and rear cover member retains the terminated cable ends in body member 16. Lateral edges of slots 48 are rounded facilitating bending of cables 12 at right angles upon exiting connector assembly 10, with inner strut 40 being slightly higher to hold the cable crossing thereover at an elevation slightly higher than the plane of the non-crossing cable after bending. Rear cover member 30 is similar to the rear cover member disclosed in U.S. patent application Ser. No. 07/386,536 filed July 28, 1989 and assigned to the assignee hereof.

Figure 3:
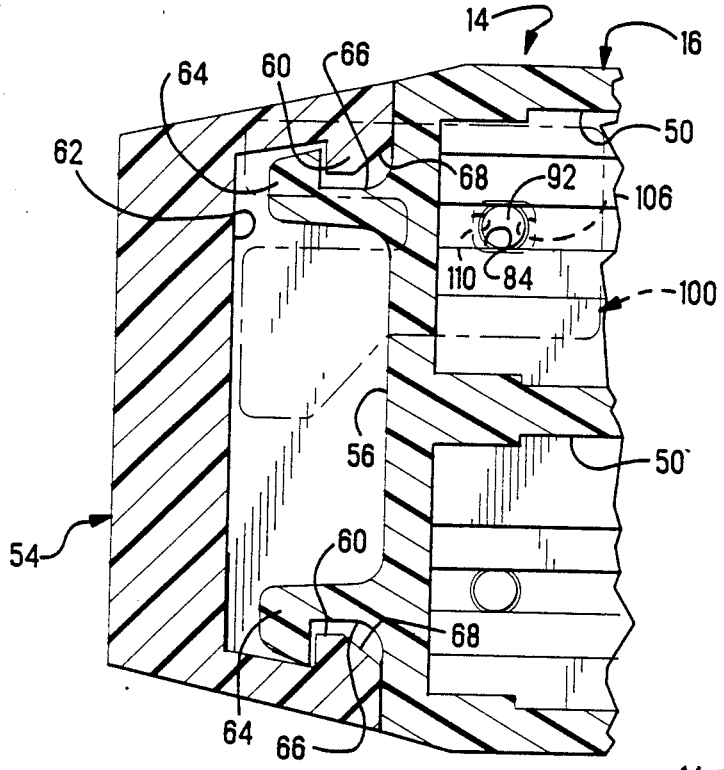
FIGS. 3 and 4 are part section views taken along lines 3—3 and 4—4 of FIG. 1, showing respectively the guides and channels for the locking and unlocking vertical movement of one of the pair of lock plates of the present connector, and a detent in a detent recess in an unactuated position, both also showing in phantom a lock plate around a pin.

Side members 54 are securable to side faces 56 of body member 16 to serve as lock actuators. Inside faces 58 of side members 54 include two vertically spaced pairs of horizontally spaced undercut vertical ledges 60 having outwardly facing bearing surfaces, with ledges 60 of each pair extending toward each other into large recesses 62. Side faces 56 of body member 16 include corresponding pairs of latchable guide rails 64 defining vertical guide channels 66 open outwardly away from each other into which ledges 60 extend when side members 54 are snapped onto the side faces of body member 16 and guide rails 64 are received into large recesses 62, as seen in FIG. 3. During assembly the portions of ledges 60 which first engage portions of guide rails 64 are tapered at 68 to facilitate inward deflection of guide rails 64 until ledges 60 snap into guide channels 66. Body member 16 and side members 54 may be molded of plastic resin such as glass-filled polyester. The entire connector assembly 14 can easily be snapped together without any additional fastening means, facilitating assembly.

Figure 4:
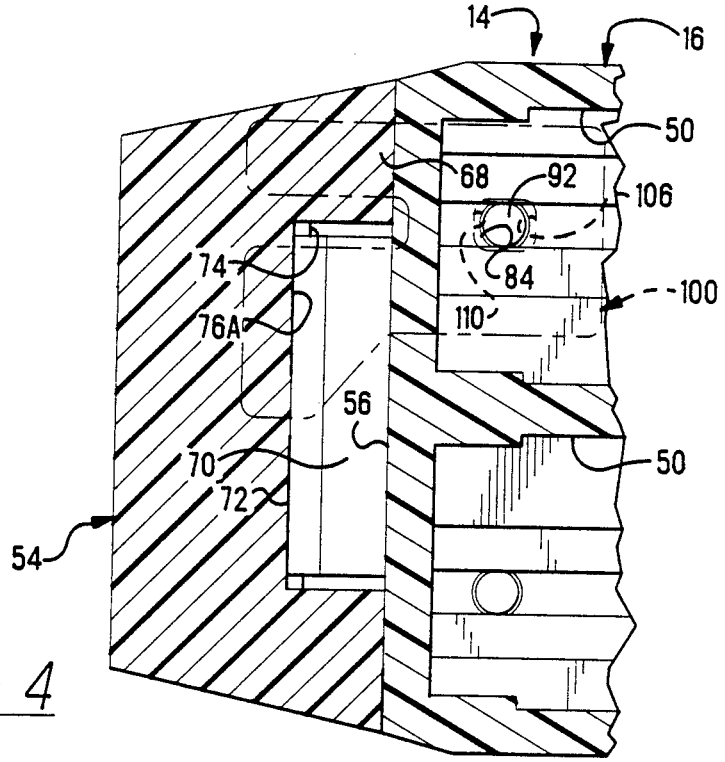
Figure 7A:
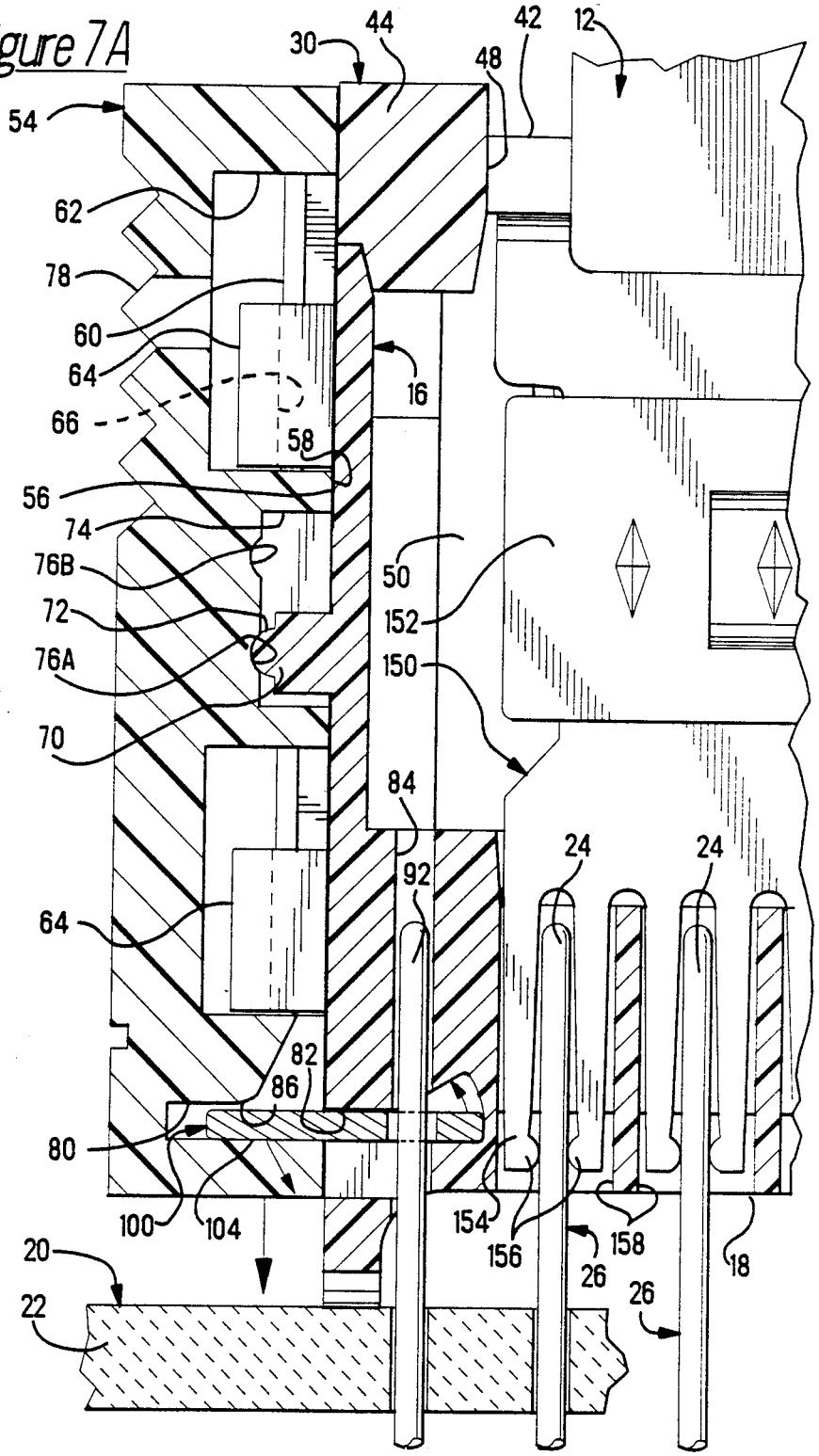
FIGS. 7A and 7B are elevation part section views of one of the pair of locking systems of the present invention, before and after locking onto the pin array.
Figure 7B:
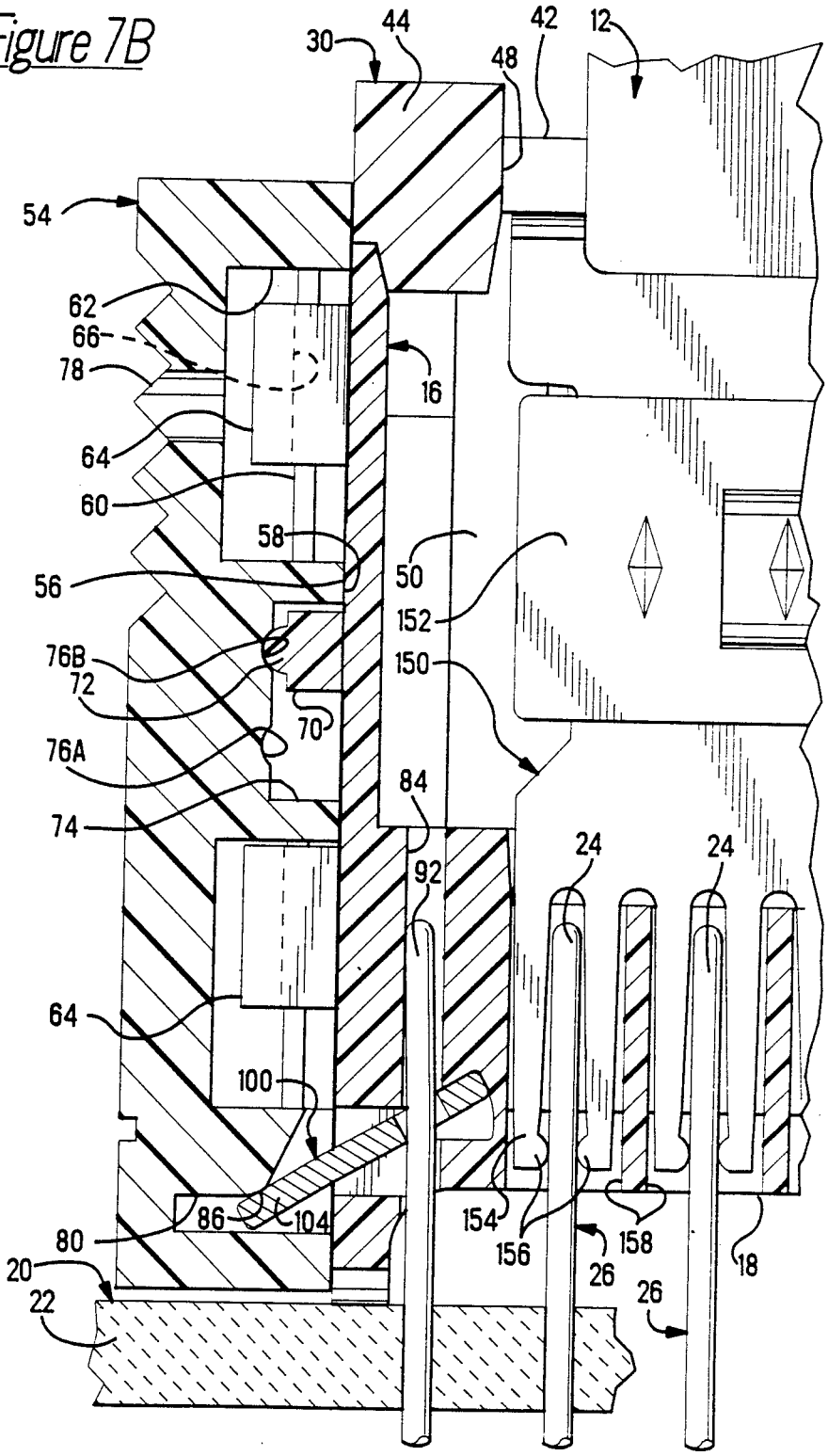
Figure 9A:
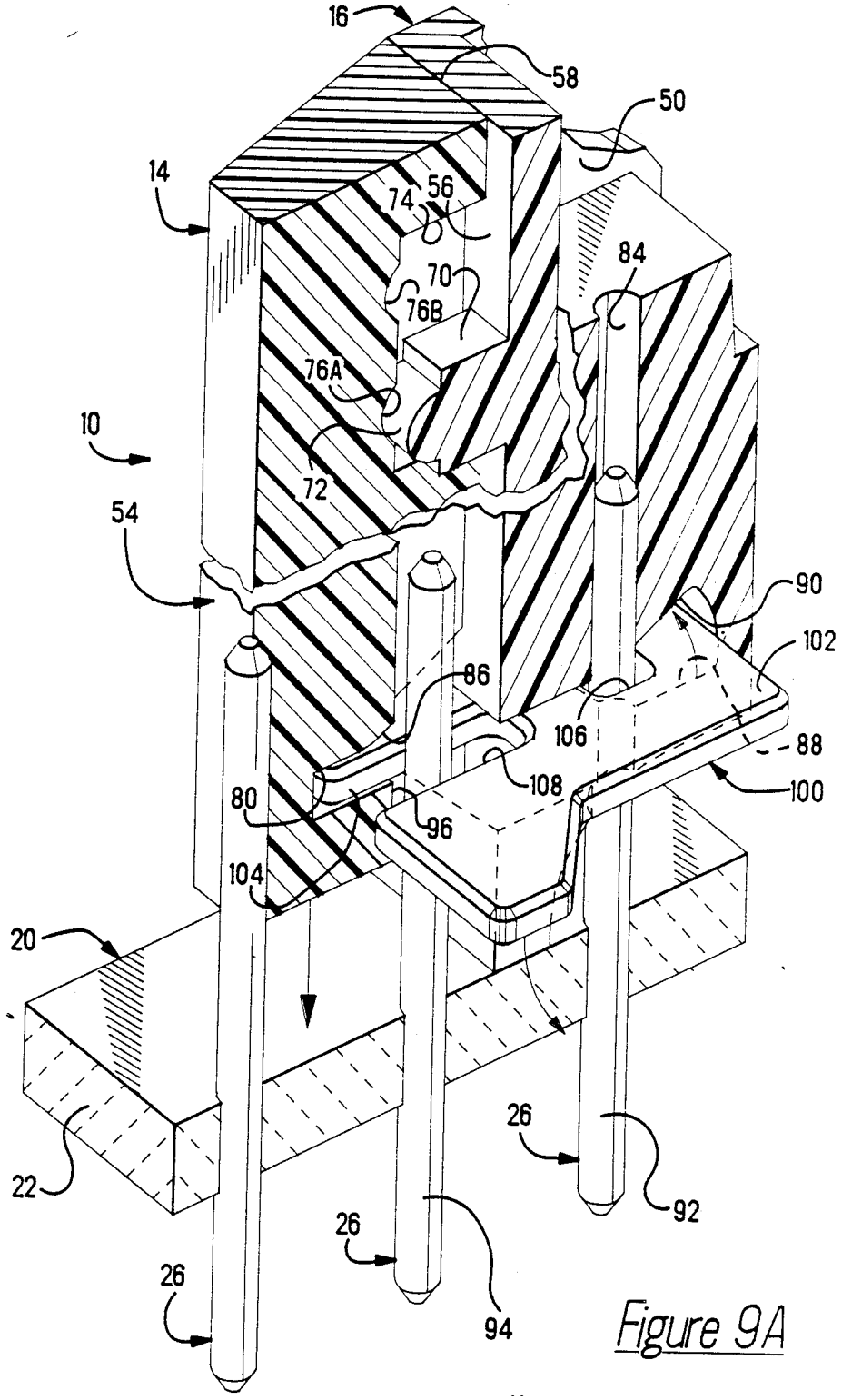
FIGS. 9A and 9B are perspective section views broken to illustrate the actuation of the locking system of FIGS. 7A and 7B.
Figure 9B:
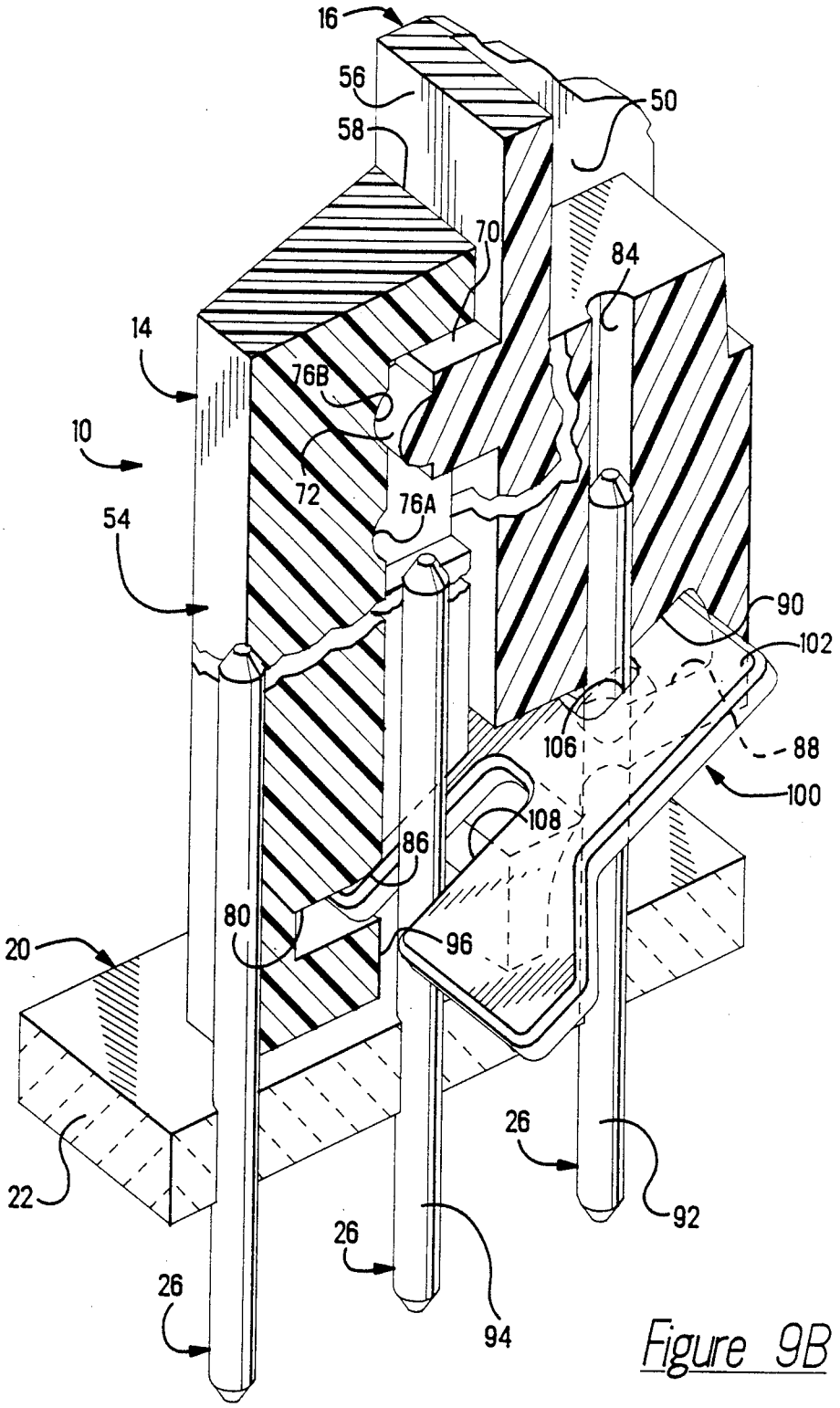

After assembly side members 54 are slidable vertically along side faces 56 of body member 16 between an unactuated position and an actuated position, as seen in FIGS. 7A and 7B respectively. Referring to FIGS. 2 and 4, a horizontal projection 70 extends outwardly of each side face 56 of body member 16 to a rounded elongate detent 72. Each projection 70 is received into a recess 74 of an inner face 58 of a respective side member 54, and the rounded detent 72 thereof is received tightly into a correspondingly rounded elongate first channel 76A defining a first or unactuated position (FIGS. 7A and 9A), or into an elongate second channel 76B parallel to channel 76A and spaced thereabove, defining a second or actuated position (FIGS. 7B and 9B). Serrated surfaces 78 at upper ends of side members 54 are easily gripped both by one hand for both side members to be pushed downwardly or pulled upwardly simultaneously for actuation and deactuation respectively.

With reference to FIGS. 5 and 7A, lock member 100 is plate-shaped and has an inward end section 102 and an outward end section 104. A pin-receiving hole 106 extends through inward end section 102, and preferable a pin-receiving slot 108 extends inwardly from the outer end of outward end section 104. Lock plate 100 preferably is made of metal such as stainless steel having significant spring properties retained during long in-service use. A lock plate 100 is assembled at each end of housing assembly 14 between each side member 54 and a respective side face 56 of body member 16, with inward end section 102 disposed in shaped recess 82 of body member 16, and outward end section 104 disposed in shaped recess 80 of a respective side member 54, as side members 54 are snapped securely to side faces 56 of body member 16. Shaped recess 82 of body member 16 is best illustrated in FIG. 6 and can be obtained for example by molding or by machining a previously molded body member 16. Upon assembly into housing assembly 14, pin-receiving hole 106 is aligned with pin-receiving passageway 84 extending upwardly from mating face 18 of housing assembly 14, for receiving thereinto and therealong a pin section of a pin contact 92 of the pin field during mounting of connector assembly 10 onto the pin field.

Figure 8:
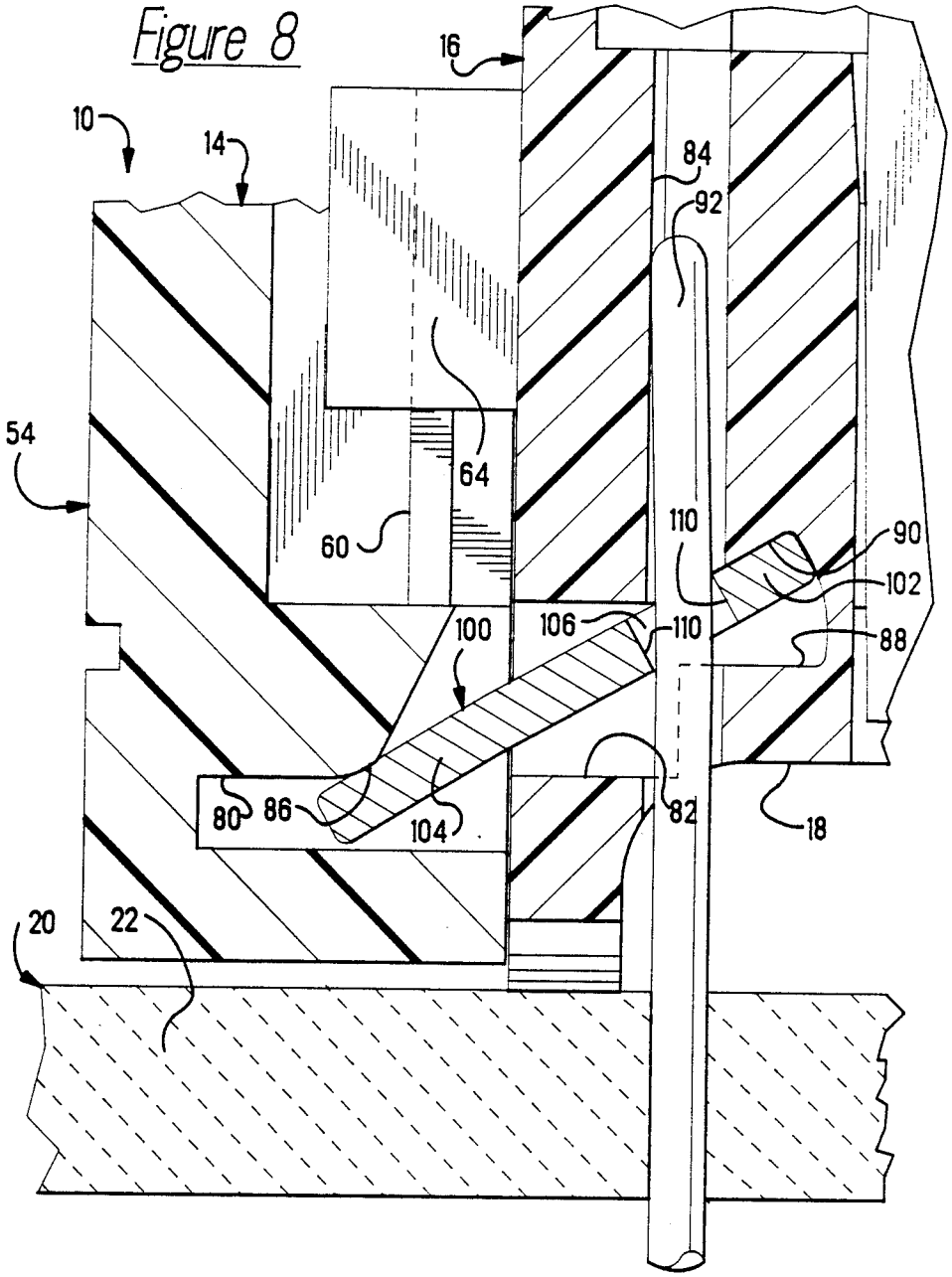
FIG. 8 is an enlarged section view of the lock plate locked onto a pin as in FIG. 7B.

FIGS. 7A,7B and 9A,9B illustrate the actuation of the locking system of connector assembly 10 at one end;

each locking system at each end comprises a lock plate 100 and a side member 54 and the detent arrangement 72,76A,76B., all in cooperation with a respective sacrificed pin contact 92 of the pin field 20. In FIGS. 7A, 7B and 8 there is no pin contact 26 shown to the left of sacrificed pin 92, in order to facilitate explanation of the present invention, although connector assembly 10 is adapted to provide for the existence of contact members 94 located thereat (but not used electrically) in a continuous pin field as shown in FIGS. 9A and 9B. For purposes of demonstrating the actuation the detent arrangement is shown positioned just above lock plate 100 in FIGS. 6A and 6B.

Shown in FIGS. 7A,7B is a portion of one of the terminals 150 terminated to the flat conductor of one of the flat cables 12 and retained within a respective cavity 50. The terminations 152 by which terminals 150 are affixed to cable 12 are preferably of the crimping and staking type especially suitable for flat power cable as disclosed in U.S. patent application Ser. No. 07/338,079 filed Apr. 14, 1989 and assigned to the assignee hereof, and also similar to that disclosed in U.S. Pat. Nos. 4,859,204 and 4,867,700. Terminals 150 include arrays of tuning fork-shaped receptacle contact sections 154 matable with the pin contact sections 24 of pins 26 of the pin array 20, each contact section 154 having two opposing embossed tines !56 disposed within a passageway 158 of body member 16 of housing assembly 14 and recessed from mating face 18, and adapted to be deflected apart under spring bias by a respective pin contact section 24 upon mating for assured electrical connection therewith.

Prior to actuation, detent 72 is held in the first, unactuated position in recess 76A as side member 54 is in its upper unactuated position along side face 56 of body member 16, and lock plate 100 is disposed in a horizontal orientation within aligned shaped recesses 80,82 together defining a space having a horizontal length only incrementally greater than that of lock plate 100. Recess 80 in side member 54 is dimensioned at the outward end generally vertically to be just greater than the thickness of lock plate 100. Preferably where side face recess 82 intersects pin-receiving passageway 84, its vertical dimension is only incrementally greater than the thickness of lock plate, and lower surface 88 preferably concludes at an outer edge aligned with passageway 84 to serve as a fulcrum during actuation. Pin contact 92 extends upwardly into passageway 84 and through aperture 106 of lock plate 100; aperture 106 is precisely dimensioned at least between opposed side walls 110 to be slightly larger than the pin dimension in a direction extending between inward end section 102 and outward end section 104. At least the upper portion of passageway 84 is dimensioned to be only incrementally larger than the pin contact dimension. Since connector assembly 10 is shown to be a two-row connector for mating with two rows of the pin field, it is preferred for the locking system to lock onto a pin contact 92 of one row at one end and a contact 92 of the other row at the other end.

Upon actuation, side member 54 (along with the side member at the other end of connector assembly) is urged downwardly along side face 56 of body member 16 thus moving detent 72 from lower recess 76A to upper recess 76B which defines the second, actuated position. Actuation rotates lock member 100 about that portion of pin contact 92 extending through pin-receiving aperture 106 to an angled orientation about 30° from horizontal. Rounded bearing surface 86 of recess 80 in side member 54 urges outward end section 104 downwardly, while the outer edge of lower surface 88 of recess 82 in side face 56 acts as a fulcrum to relatively urge inward end 102 upwardly against stop surface 90 angled upwardly and inwardly from the location where passageway 84 intersects recess 82. Inner and outer sides 110 of pin-receiving aperture 106 through lock plate 100 preferably have sharp edges which are forced tightly against surface portions of pin 92 biting somewhat into the pin, and remain held tightly thereagainst under static torque by stop surface 90, thus locking connector assembly 10 onto pin field 20 as shown in FIG. 8. Being only incrementally larger than pin contact 92, passageway 84 allows only incremental deflection or bending of the upper end of pin contact 92. Side member recess 80 inwardly of bearing surface 86 is enlarged for clearance so as not to interfere with relative upward movement of the central plate portion thereinto, and side face recess 82 is similarly enlarged for clearance outwardly of the fulcrum edge of lower surface 88 so as not to interfere With relative downward movement of the central plate portion thereinto.

In the embodiment shown a parallel passageway also extends into body member 16 to receive the pin contact of the adjacent row aligned with pin contact 92. Pin contacts 92 and those of the adjacent rows aligned therewith would not be electrically engaged by contacts 154 of connector 10 and would not be utilized by the circuitry of the printed circuit board 22 to which the pin array is mounted, nor would pins 94 outwardly therefrom.

Referring to FIGS. 2, 9A and 9B it can be seen that connector assembly 10 is adapted to receive pin contacts 94 outward from pins 92 of each of the two rows and those of the other row aligned therewith of pin field 20 which would otherwise be located where portions of the structure of side members 54 are situated, relative to those of pin contacts 26 which are to be electrically connected to cables 12,12 by contact sections 154. Side members 54 include relief channels or openings 96 which receive thereinto outward pin contacts 94, and one of the relief channels 96 is shown intersecting recess 80, thus permitting connector assembly 10 to be used in a continuous pin field. Lock plate 100 is also adapted for one of pins 94 by virtue of slot 108 extending thereinto from the outer edge of outward end 104 and aligned with aperture 106 and which intersects one of the openings 96, which permits lock plate rotation about pin 92 so that the outer plate edge is moved relatively inwardly toward body member 16 without the lock plate engaging pin 94.

The same lock plates can be used with different side members and body members, and the same side members can be adapted for use with slightly different spacings between pins of arrays by enlarging the width of the relief openings 96, for use with any of several body members having appropriately spaced pin-receiving passageways across its mating face. A connector utilizing the locking system of the present invention may also be a single row or multi-row connector. The connector could be used to connect a plurality of signal conductors to respective pins by separate terminals, or signal and ground conductors by separate terminal means. In a multi-row connector for example four locking plates could be utilized actuated by a single pair of side members thus locking onto four pin contacts at four corners of an array. Other detent means and bearing means and rotation-stopping means could also be used, and slightly different locking members could be devised. Also, other means may be used to secure the side members to the body member, and other guide means may be substituted which permit relative vertical movement of the side members with respect to the body member while holding the members close together for properly controlled pivoting of the lock plates.

Various other modifications of the preferred embodiment herein disclosed may be devised and are within the spirit of the invention and the scope of the claims.

What is claimed is:

1. An electrical connector for assembling to electrical conductor means having terminal means terminated thereon, for mounting to a pin field and self-securing thereto to connect said electrical conductor means to said pin field, comprising:

an assembly including a body member defining terminal-receiving cavity means therein in which terminal means terminated to conductor means are to be disposed having electrical contact means exposed along a mating face for electrical connection to corresponding pins of a pin field, said assembly further including means for retaining said terminal means therein, and further including an integral locking system cooperable with selected pins of said pin field;

said locking system being defined by a pair of side members securable along respective side faces of said body member, and a pair of lock plates retained within the assembly each by a respective said side member along a respective said side face of said body member;

each said side member being secured onto a respective side face of the body member in a manner permitting movement thereof vertically along said side face between an unactuated position and an actuated position;

each side member including a lock plate recess opposed from a lock plate recess in said side face of said body member, and a respective said lock plate is trapped loosely therein and therebetween in a horizontal orientation with an inward end in said side face recess and an outward end in said side member recess;

each said lock plate including a pin-receiving aperture through which extends a selected pin of said pin array upon connector mounting to said pin array, to which said lock plate locks upon actuation of the respective side member;

each said side member including means for bearing downwardly against said outward end of a respective said lock plate and said body member including cooperable stop means for stopping said inward end of each said lock plate against rotational movement beyond a selected desired angle upon actuation and maintaining said lock plate at an angle with side walls of said pin-receiving aperture under static torque against said selected pin; and said assembly further including means holding said locking system in said actuated position, whereby said lock plates are pivotable in a vertical plane of rotation about said selected pin extending through said pin-receiving aperture for side walls of said aperture to be urged tightly against said selected pin and tending to bite thereinto, thereby locking said connector to said selected pins, and said connector is matable with a pin field and mountable thereonto by an integral locking system not requiring mounting hardware.

2. An electrical connector as set forth in claim 1 further including means holding said locking system in said unactuated position.

3. An electrical connector as set forth in claim 2 wherein said holding means comprise detents along one of said side members and said side faces and a pair of detent recesses associated with each of said detents along the other of said side members and said side faces, said recesses defining said actuated and unactuated positions.

4. An electrical connector as set forth in claim 1 wherein said bearing means of each said side member is an upper surface portion of said side member recess adjacent an upper surface of said lock plate spaced inwardly from an outer edge of said outward end thereof.

5. An electrical connector as set forth in claim 1 wherein said stop means of each said side face of said body member is an upper surface portion of said side face recess adjacent an upper surface of said lock plate located at least as an inner edge of said inward end thereof.

6. An electrical connector as set forth in claim 5 wherein said upper surface portion stop means is an angled surface extending inwardly and upwardly from a location at which a passageway of said body member for receiving a said selected pin thereinto intersects said side face recess.

7. An electrical connector as set forth in claim 6 wherein a lower surface portion of said side face recess supporting said inward end of said lock plate concludes at an outer edge where said pin-receiving passageway intersects said side face recess defining a fulcrum for pivoting said lock plate at said selected pin.

8. An electrical connector as set forth in claim 7 wherein said bearing means of each said side member is an upper surface portion of said side member recess adjacent an upper surface of said lock plate spaced inwardly from an outer edge of said outward end thereof, and an outer end of each said side member recess and each said side face recess at said pivot location have respective height dimensions just greater than the thickness of a said lock plate and are precisely opposed from each other permitting horizontal orientation of said lock plate in said unactuated position and become vertically offset from each other in said actuated position, and said opposed recesses are otherwise shaped to be adapted to provide relief spaces for portions of said lock plate permitting pivoting thereof.

9. An electrical connector as set forth in claim 8 wherein said bearing surface, said stop means, said fulcrum, and said detent positions and said side member and side face recesses are located and the length of said pin-receiving aperture selected all to achieve an ultimate angle of said pivoted lock plate of about 30°.

10. An electrical connector as set forth in claim 1 wherein each said body member includes a pin-receiving passageway vertically intersecting each said side face recess for receiving thereinto from said mating face each said selected pin to extend through said pin-receiving aperture of a respective said lock plate.

11. An electrical connector as set forth in claim 10 wherein each said pin-receiving passageway is closely dimensioned at least above said side face recess to hold an upper end of a said selected pin against bending upon being subjected to static torque by a said lock plate upon pivoting during and after actuation.

12. An electrical connector as set forth in claim 1 wherein said assembly is a two-row connector for electrically connecting with two rows of pins of said pin field and said lock plates are disposed in said assembly at diagonally opposed corners thereof for locking onto a said selected pin of each row of said two rows of pins at opposed ends of said two rows, and said assembly includes additional pin-receiving passageways for receiving thereinto pins aligned with said selected pins but in the other row therefrom.

13. An electrical connector as set forth in claim 12 wherein said assembly further includes openings for receiving pins located adjacent but outwardly from said selected pins and said pins aligned therewith, said connector thus being adapted to be mounted in a continuous pin field.

14. An electrical connector as set forth in claim 13 wherein said outward end of each said locking plate intersects a said opening and includes a slot extending inwardly from an outer edge thereof and aligned with said pin-receiving aperture and intersecting said opening to receive thereinto and therethrough a respective said outward pin and to permit pivoting of said lock plate about said selected pin upon actuation without said lock plate engaging said outward pin.

15. An electrical connector as set forth in claim 1 wherein one of said side members and said side faces include at least a spaced pair of projections extending toward the other thereof defining oppositely facing vertical guide channels, and the other of said side members and said side faces include recess means for receiving said pair of projections and including corresponding projections extending into said guide channels after said side members are secured to said side faces, said projections and said corresponding projections defining means for permitting relative vertical movement therebetween while securing said side members to said body member.

16. An electrical connector assembled onto electrical conductor means having terminal means terminated thereon, said terminal means including contact means extending through respective contact passageways to be exposed along a mating face for mating with corresponding pin contacts, for mounting to a pin field and self-securing thereto to connect said electrical conductor means to said pin field, comprising:

an assembly including a body member defining terminal-receiving cavity means therein in which terminal means terminated to conductor means are disposed having electrical contact means exposed along a mating face for electrical connection to corresponding pins of a pin field, said assembly further including means for retaining said terminal means therein, and further including an integral locking system cooperable with selected pins of said pin field;

said locking system being defined by a pair of side members securable along respective side faces of said body member, and a pair of lock plates retained within the assembly each by a respective said side member along a respective said side face of said body member;

each said side member being secured onto a respective side face of the body member in a manner permitting movement thereof vertically along said side face between an unactuated position and an actuated position;

each side member including a lock plate recess opposed from a lock plate recess in said side face of said body member, and a respective said lock plate is trapped loosely therein and therebetween in a horizontal orientation with an inward end in said side face recess and an outward end in said side member recess;

each said lock plate including a pin-receiving aperture through which extends a selected pin of said pin array upon connector mounting to said pin array, to which said lock plate locks upon actuation of the respective side member;

each said side member including means for bearing downwardly against said outward end of a respective said lock plate and said body member including cooperable stop means for stopping said inward end of each said lock plate against rotational movement beyond a selected desired angle upon actuation and maintaining said lock plate at an angle with side walls of said pin-receiving aperture under static torque against said selected pin; and said assembly further including means holding said locking system in said actuated position, whereby said lock plates are pivotable in a vertical plane of rotation about said selected pin extending through said pin-receiving aperture for side walls of said aperture to be urged tightly against said selected pin and tending to bite thereinto, thereby locking said connector to said selected pins, and said connector is matable with a pin field and mountable thereonto by an integral locking system not requiring mounting hardware.

17. An electrical connector assembly as set forth in claim 16 wherein said means for retaining said terminal means in said body member is a rear cover member fastenable to a rear face of said body member opposed from said mating face.

18. An electrical connector assembly as set forth in claim 16 wherein said electrical conductor means is adapted to transmit electrical power and said connector assembly transmits electrical power to said pin field, said conductor means comprises two flat cable means having flat conductor members therein, and said terminal means comprise terminals terminated to said flat conductor members and each includes a plurality of said contact means in a common row for electrically engaging a like plurality of pin contacts in a corresponding row.

19. An electrical connector assembly as set forth in claim 18 wherein said means for retaining said terminal means in said body member is a rear cover member fastenable to a rear face of said body member opposed from said mating face, and said rear cover member includes an inner strut and two outer struts on either side thereof all extending from a bight section to free ends defining respective cable exits between said inner strut and said outer struts for said two flat cable means coextending from said assembly in parallel planes, said free ends of said outer struts being incrementally separable from said inner strut free end to permit slight deflection apart for insertion around and between both said flat cable means from a common side, and said free ends being held firmly together upon said rear cover member being secured to said rear face of said body member, whereby said rear cover member may be an integral member.

20. A system for locking a device onto an array of parallel pin members coextending from a surface and self-securing to said array, the device including a body member, said locking system comprising:

at least one side member securable along a respective side face of said body member, and at least one lock plate retained therebetween and associated with a selected pin of said array;

each said side member being secured onto a respective side face of the body member in a manner permitting movement thereof vertically along said side face between an unactuated position and an actuated position;

each side member including a lock plate recess opposed from a lock plate recess in said side face of said body member, and a respective said lock plate is trapped loosely therein and therebetween in a horizontal orientation with an inward end in said side face recess and an outward end in said side member recess;

each said lock plate including a pin-receiving aperture through which extends said selected pin upon mounting of the device to said pin array, to which said lock plate locks upon actuation of the respective side member;

each said side member including means for bearing downwardly against said outward end of a respective said lock plate and said body member including cooperable stop means for stopping said inward end of each said lock plate against rotational movement beyond a selected desired angle upon actuation and maintaining said lock plate at an angle with side walls of said pin-receiving aperture under static torque against said selected pin; and said assembly further including means holding said locking system in said actuated position, whereby said lock plates are pivotable in a vertical plane of rotation about said selected pin extending through said pin-receiving aperture for side walls of said aperture to be urged tightly against said pin and tending to bite thereinto, thereby locking said device to said selected pins, and said device is mountable onto a pin field by an integral locking system not requiring mounting hardware.

* * * * *